US006932345B1

(12) United States Patent
O'Dell

(10) Patent No.: US 6,932,345 B1
(45) Date of Patent: Aug. 23, 2005

(54) PORTABLE BEAN BAG TOSS GAME ASSEMBLY

(76) Inventor: Robert G. O'Dell, 7193 Lakeside Rd., Ontario, NY (US) 14519

( * ) Notice: Subject to any disclaimer, the term of this patent is extended or adjusted under 35 U.S.C. 154(b) by 0 days.

(21) Appl. No.: 10/855,661

(22) Filed: May 28, 2004

(51) Int. Cl.[7] ..... A63B 63/00
(52) U.S. Cl. ..... 273/402
(58) Field of Search ..... 273/398–402

(56) References Cited

U.S. PATENT DOCUMENTS

| | | | | |
|---|---|---|---|---|
| 406,342 | A * | 7/1889 | Dumont | 273/402 |
| 1,636,920 | A * | 7/1927 | Nichols | 273/402 |
| 2,504,818 | A * | 4/1950 | Findon | 273/402 |
| 3,035,838 | A * | 5/1962 | Johnston | 273/400 |
| 4,022,472 | A * | 5/1977 | Seals | 273/400 |
| 4,565,375 | A | 1/1986 | Dresel | |
| 4,927,160 | A * | 5/1990 | Nichol et al. | 273/371 |
| 4,938,485 | A | 7/1990 | Hockridge et al. | |
| 4,943,065 | A | 7/1990 | DeLapa | |
| D340,082 | S | 10/1993 | DeLapa | |
| 5,320,360 | A * | 6/1994 | St. Pierre | 273/402 |
| 5,553,862 | A | 9/1996 | Konotopsky | |
| D375,125 | S | 10/1996 | Mallek et al. | |
| 5,765,832 | A * | 6/1998 | Huff | 273/354 |
| 5,871,216 | A * | 2/1999 | Sparacino | 273/402 |
| 6,032,826 | A | 3/2000 | Libit et al. | |
| 6,244,598 | B1 * | 6/2001 | Conville | 273/402 |
| 6,669,200 | B1 * | 12/2003 | Knetsch et al. | 273/400 |
| 6,755,711 | B2 * | 6/2004 | McClung et al. | 446/46 |
| 2004/0239036 | A1 * | 12/2004 | Fairbanks | 273/400 |

* cited by examiner

*Primary Examiner*—Mark S. Graham

(57) ABSTRACT

A toss game assembly includes a plurality of game targets that can advantageously be disassembled and stored during non-operating conditions. Each targets includes a top member provided with an aperture, a rear member provided with a plurality of slots, and a pair of side members having flange portions integral therewith and engageable with select ones of the plurality of slots. The assembly further includes a beverage supporting section removably attachable to the rear member for conveniently maintaining beverage vessels thereon. A plurality of mobile members can be repeatedly tossed between the plurality of targets and into the respective apertures.

18 Claims, 5 Drawing Sheets

PORTABLE BEAN BAG TOSS GAME ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a toss game and, more particularly, to a portable bean bag toss game assembly for providing amusing recreational activity.

2. Prior Art

Bean bag toss games are well known in the prior art wherein opponents attempt to position a number of bean bags within a target. Toys and games of the prior art have included varying target-type games in an effort to position a projectile relative to a target. One example sets forth a spherical type game device wherein the projectile is preferably shaped as a sphere wherein it (the projectile) may be assembled into two more complementary parts during a trajectory to challenge players associated with the game.

Another example sets forth a plurality of trapezoidally shaped sections assembled to provide a basket type for association with ball-type projectiles. In yet another example the game utilizes a disk-shaped projectile directed towards a scoring platform including a plurality of surfaces upon which the projectile may come to rest wherein the plurality of surfaces of the projectile and positioning on the scoring platform determines scoring of the game.

There is also an example that sets forth a toy ball wherein the interior thereof may be pivotally opened to include various items therein whereupon striking a surface of the ball disengages the latch to open the ball.

The portability of all these examples however, is very limited, confining the game play to one specific area. As is well known, children tend not to like being confined to one area while they are at play.

Accordingly, a need remains for a portable bean bag toss game assembly that overcomes the above-noted shortcomings.

BRIEF SUMMARY OF THE INVENTION

In view of the foregoing background, it is therefore an object of the present invention to provide a portable bean bag toss game assembly for providing amusing recreational activity. These and other objects, features, and advantages of the invention are provided by an assembly including a plurality of game targets that are spaced apart at select distances, as desired by players. Each of the plurality of targets includes a top member that has a centrally disposed longitudinal axis, provided with an aperture, preferably centered along the axis, and having a substantially annular shape. The top member preferably includes a plurality of elongated rails secured thereto and oppositely spaced from the axis for conveniently assisting a player to transport the plurality of targets between remote locations.

The plurality of targets further include a rear member provided with a plurality of slots, and each has a top edge portion removably engageable with the top member wherein the axis is offset at a select angle, preferably measuring approximately 45 degrees, from a horizontal plane.

The present invention also includes a plurality of triangular side members that has flange portions integral therewith and extending outwardly for slidably engaging with select ones of the plurality of slots. Such a plurality of flange portions are spaced along one edge portion thereof.

The assembly further includes a beverage supporting section removably attachable to the rear member that includes a bottom surface for conveniently maintaining beverage vessels thereon during operating conditions. The beverage supporting section includes a plurality of oppositely spaced support members that have a plurality of flange portions slidably engageable with associated ones of the plurality of slots. Advantageously, the plurality of support members each has a groove formed therein and facing inwardly toward the axis for removably receiving and effectively maintaining the bottom surface at a substantially horizontal position during operating conditions.

The present invention also includes a plurality of mobile members, such as bean bags, for example, that are repeatedly tossed between the plurality of targets and into the respective apertures thereof. The plurality of targets can advantageously be disassembled and stored during non-operating conditions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
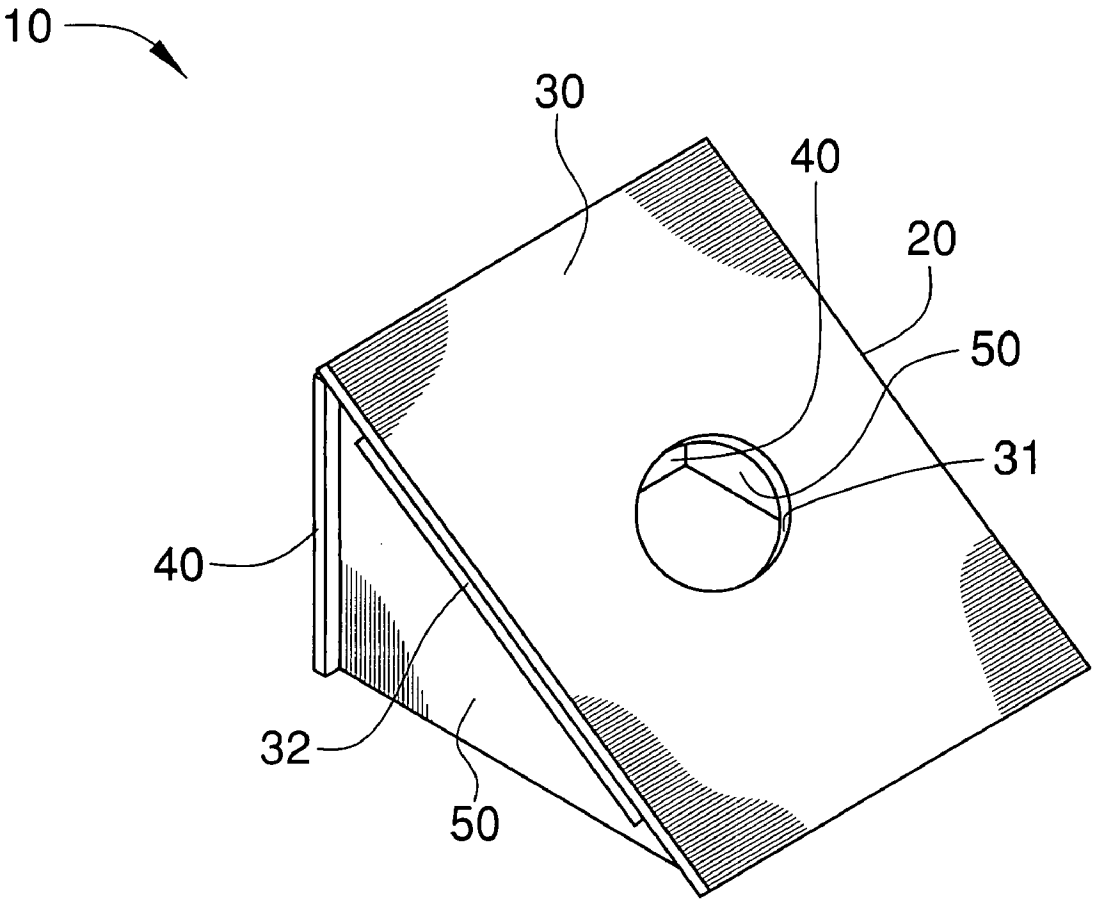
FIG. 1 is a perspective view showing a game target for a portable bean bag toss game assembly, in accordance with the present invention.
Figure 2:
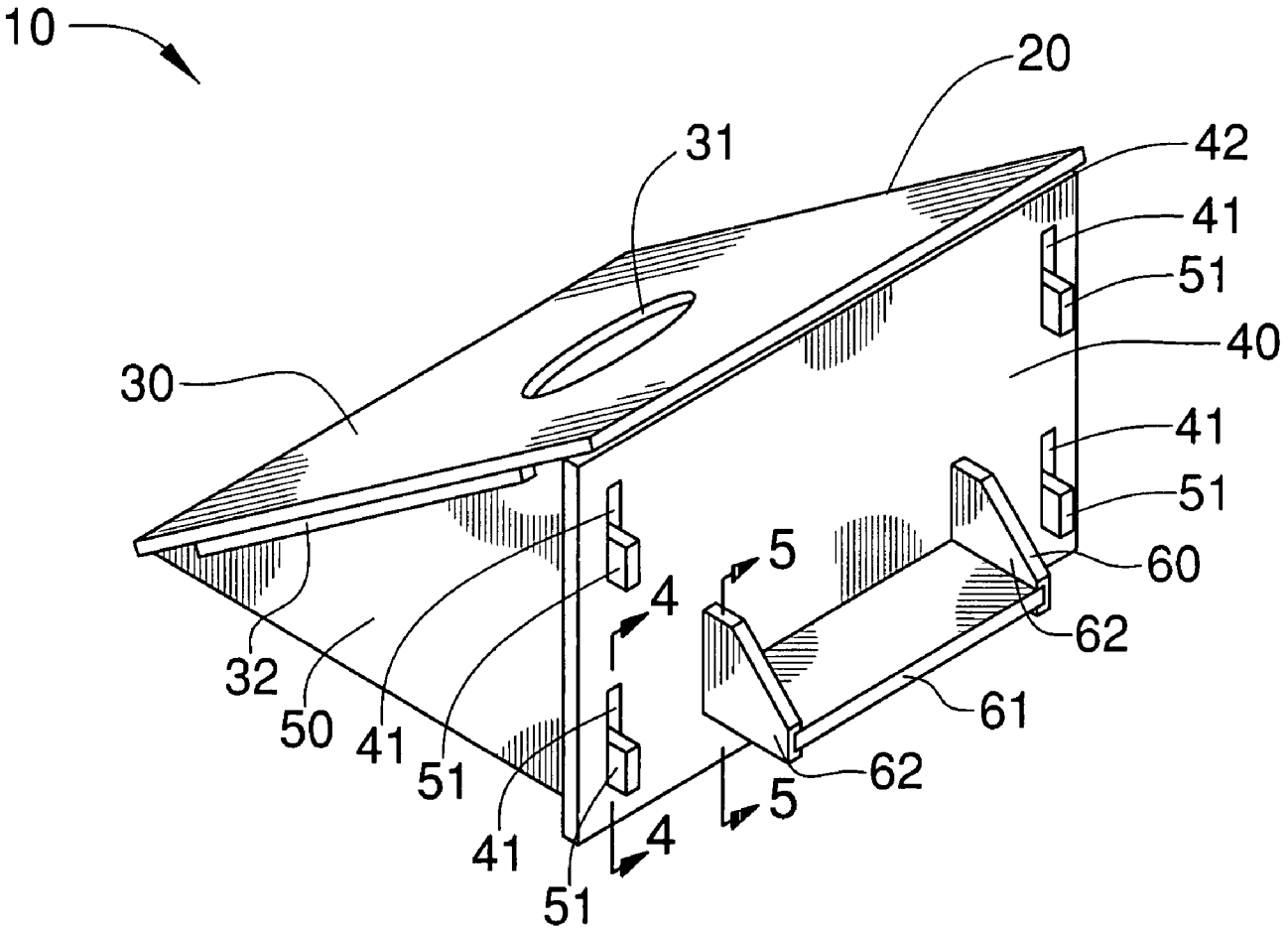
FIG. 2 is a perspective rear elevational view of the assembly shown in FIG. 1.
Figure 3:
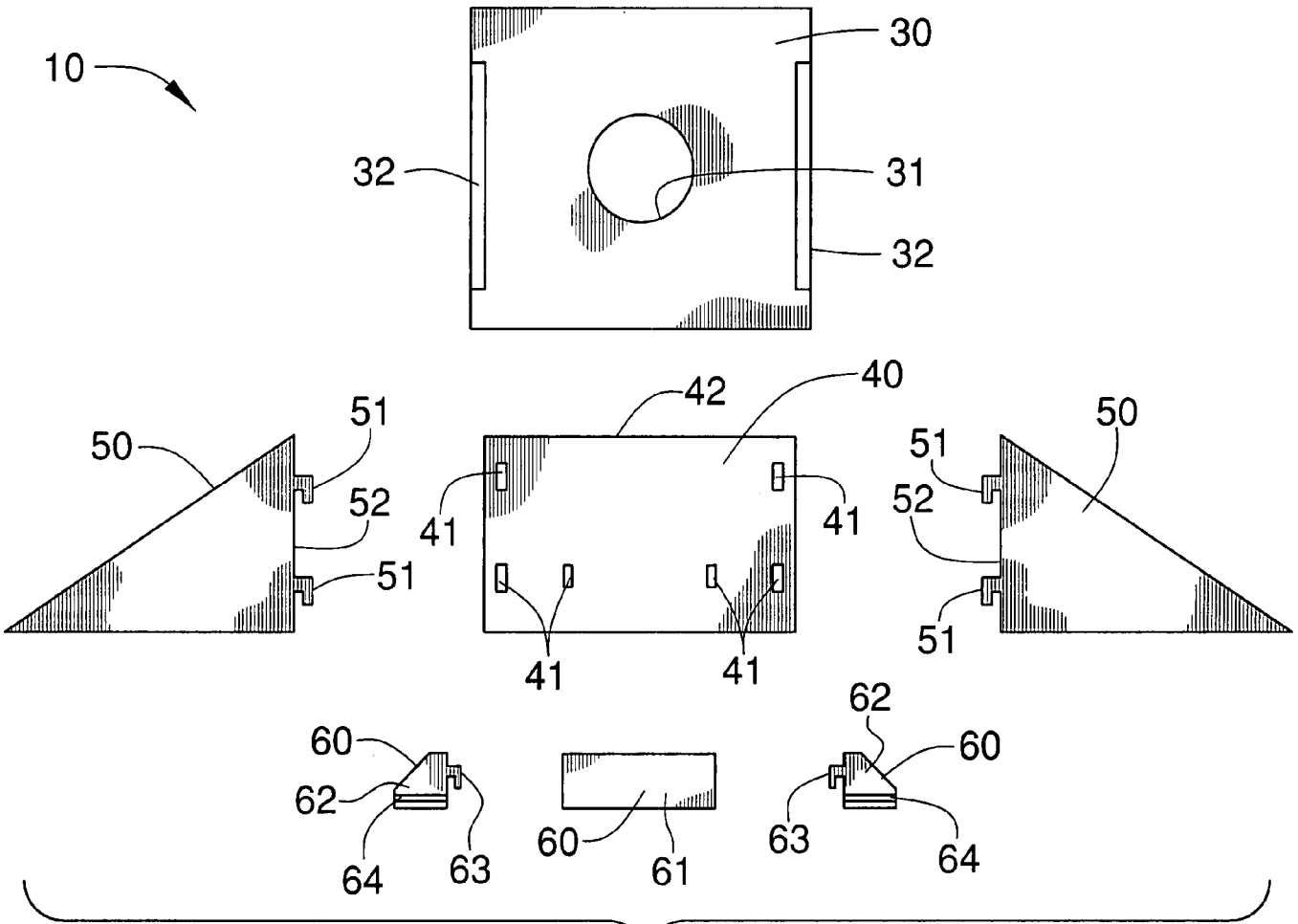
FIG. 3 is an exploded view of the assembly shown in FIG. 1.
Figure 4:
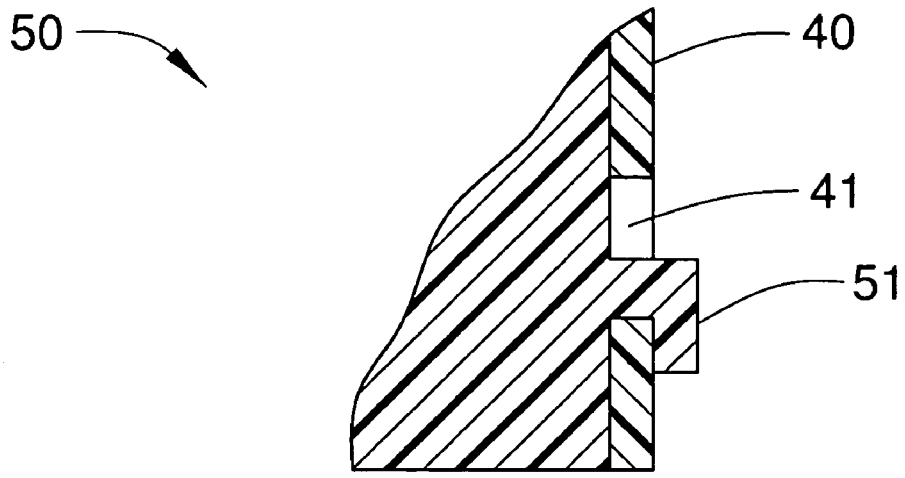
FIG. 4 is a cross-sectional view of the assembly shown in FIG. 1, taken along line 4—4.
Figure 5:
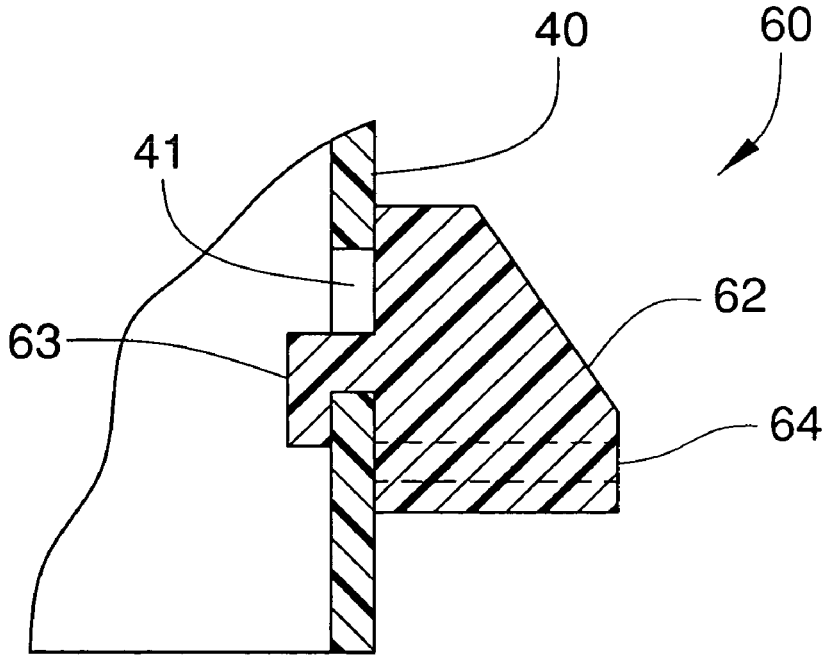
FIG. 5 is a cross-sectional view of the assembly shown in FIG. 1, taken along line 5—5.
Figure 6:
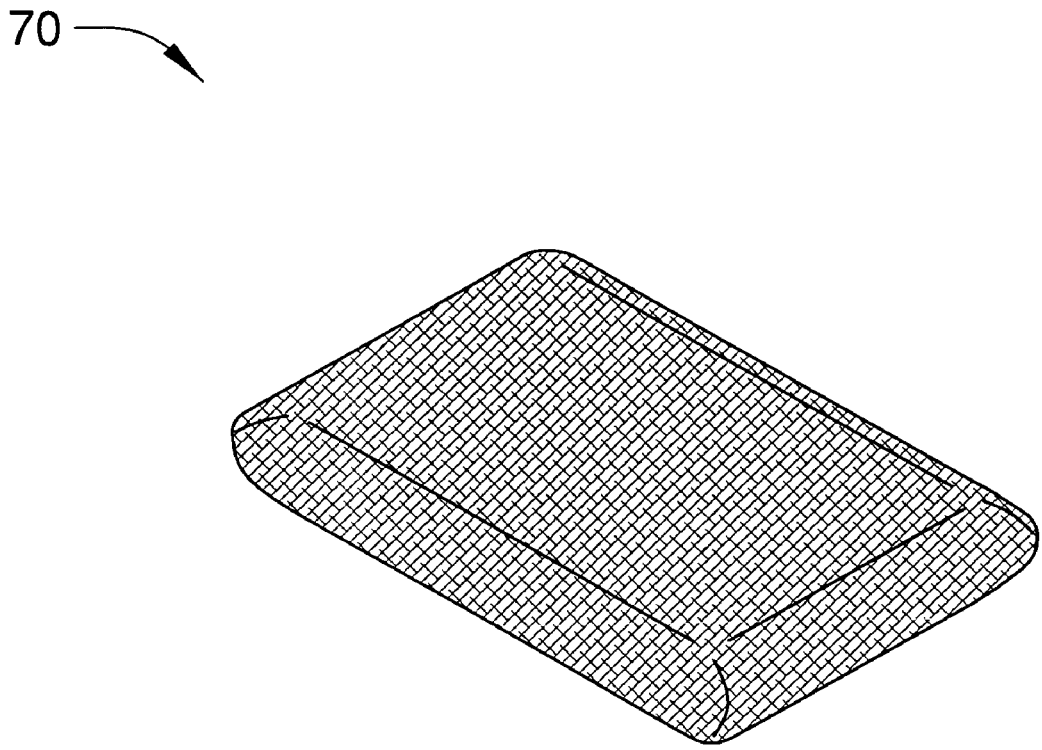
FIG. 6 is a perspective view of a mobile member.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1–6 by the reference numeral 10 and is intended to provide a portable bean bag toss game for providing amusing recreational activity. It should be understood that the apparatus 10 may be used to play many different types of bean bag toss games and should no be limited to those mentioned in the scope of this application.

Referring initially to FIG. 1, the assembly 10 includes a plurality of game targets 20 that are spaced apart at select distances, as desired by players. Each of the plurality of targets 20 includes a top member 30 that has a centrally disposed longitudinal axis, provided with an aperture 31, centered along the axis, and having a substantially annular shape. The top member 30 includes a plurality of elongated rails 32 secured thereto and oppositely spaced from the axis for conveniently assisting a player to transport the plurality of targets 20 between remote locations.

It is well known that children enjoy having sleepovers, or just simply playing at another friend's house. The portability of the assembly 10 will appeal to children of all ages who wish to take this game with them on the occasions mentioned above.

The plurality of targets 20 further include a rear member 40 provided with a plurality of slots 41, and each has a top edge portion 42 removably engageable with the top member 30 wherein the axis is offset at a select angle, measuring approximately 45 degrees, from a horizontal plane.

The present invention also includes a plurality of triangular side members 50 that has flange portions 51 integral therewith and extending outwardly for slidably engaging with select ones of the plurality of slots 41. Such a plurality of flange portions 51 are spaced along one edge portion 52 thereof.

The assembly 10 further includes a beverage supporting section 60 removably attachable to the rear member 40 that includes a bottom surface 61 for conveniently maintaining beverage vessels (not shown) thereon during operating conditions. The beverage supporting section 60 includes a plurality of oppositely spaced support members 62 that have a plurality of flange portions 63 slidably engageable with associated ones of the plurality of slots 41.

Advantageously, the plurality of support members 62 each has a groove 64 formed therein and facing inwardly toward the axis for removably receiving and effectively maintaining the bottom surface 61 at a substantially horizontal position during operating conditions. This will effectively prevent the beverages from tilting, which would make them more likely to be knocked over during game-play.

The present invention also includes a plurality of mobile members 70, such as bean bags, for example, that are repeatedly tossed between the plurality of targets 20 and into the respective apertures 31 thereof. The plurality of targets 20 can advantageously be disassembled and stored during non-operating conditions, thus preventing them from becoming an eyesore in the backyard or an obstacle in the house.

In operation, the general method of play consists of first setting up two opposing targets. The players then continue to toss their bags at the each other's targets, taking turns to throw one bag at a time. If one player should hit the aperture of the other opponent's target, whether by a direct hit or sliding in, that player scores a point. If, on the next throw in the same round of play, the opponent hits the other player's target that would cancel out the point previously scored by the first player. This game play is very safe, yet competitive, since the winner must win by two points, with the minimum winning score being five points.

The toss game is versatile enough where only two people can play, or teams of multiple players can contend against each other wherein the rules of the game are clear cut and easy to understand by children of all ages.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An assembly for providing an amusing recreational activity, said assembly comprising:

a plurality of game targets being spaced apart at select distances as desired by players, each of said plurality of targets comprising a top member having a centrally disposed longitudinal axis and being provided with an aperture having a substantially annular shape, a rear member provided with a plurality of slots and having a top edge portion removably engageable with said top member wherein the axis is offset at a select angle from a horizontal plane, a plurality of side members having flange portions integral therewith and extending outwardly for being slidably engaged with select ones of the plurality of slots, and a beverage supporting section removably attachable to said rear member and comprising a bottom surface for maintaining beverage vessels thereon during operating conditions, and a plurality of mobile members for being repeatedly tossed between said plurality of targets and into the respective apertures thereof, wherein said plurality of targets can be disassembled and stored during non-operating conditions.

2. The assembly of claim 1, wherein said top member comprises: a plurality of elongated rails secured thereto and oppositely spaced from the axis for assisting a player to transport said plurality of targets between remote locations.

3. The assembly of claim 1, wherein the angle measures approximately 45 degrees.

4. The assembly of claim 1, wherein said plurality of side members have substantially triangular shapes with said plurality of flange portions being spaced along one edge portion thereof.

5. The assembly of claim 1, wherein the plurality of apertures are centered along the axis.

6. The assembly of claim 1, wherein said beverage supporting section further comprises: a plurality of oppositely spaced support members having a plurality of flange portions slidably engageable with associated ones of the plurality of slots, said plurality of support members each having a groove formed therein and facing inwardly toward the axis for removably receiving and maintaining said bottom surface at a substantially horizontal position.

7. The assembly of claim 1, wherein said plurality of mobile members comprise: a plurality of bean bags respectively.

8. An assembly for providing an amusing recreational activity, said assembly comprising:

a plurality of game targets being spaced apart at select distances as desired by players, each of said plurality of targets comprising a top member having a centrally disposed longitudinal axis and being provided with an aperture having a substantially annular shape, said top member comprising a plurality of elongated rails secured thereto and oppositely spaced from the axis for assisting a player to transport said plurality of targets between remote locations, a rear member provided with a plurality of slots and having a top edge portion removably engageable with said top member wherein the axis is offset at a select angle from a horizontal plane, a plurality of side members having flange portions integral therewith and extending outwardly for being slidably engaged with select ones of the plurality of slots, and a beverage supporting section removably attachable to said rear member and comprising a bottom surface for maintaining beverage vessels thereon during operating conditions, and a plurality of mobile members for being repeatedly tossed between said plurality of targets and into the respective apertures thereof, wherein said plurality of targets can be disassembled and stored during non-operating conditions.

9. The assembly of claim 8, wherein the angle measures approximately 45 degrees.

10. The assembly of claim 8, wherein said plurality of side members have substantially triangular shapes with said plurality of flange portions being spaced along one edge portion thereof.

11. The assembly of claim 8, wherein the plurality of apertures are centered along the axis.

12. The assembly of claim 8, wherein said beverage supporting section further comprises: a plurality of oppositely spaced support members having a plurality of flange portions slidably engageable with associated ones of the plurality of slots, said plurality of support members each having a groove formed therein and facing inwardly toward the axis for removably receiving and maintaining said bottom surface at a substantially horizontal position.

13. The assembly of claim 8, wherein said plurality of mobile members comprise: a plurality of bean bags respectively.

14. An assembly for providing an amusing recreational activity, said assembly comprising:

a plurality of game targets being spaced apart at select distances as desired by players, each of said plurality of targets comprising a top member having a centrally disposed longitudinal axis and being provided with an aperture having a substantially annular shape, said top member comprising a plurality of elongated rails secured thereto and oppositely spaced from the axis for assisting a player to transport said plurality of targets between remote locations, a rear member provided with a plurality of slots and having a top edge portion removably engageable with said top member wherein the axis is offset at a select angle from a horizontal plane, a plurality of side members having flange portions integral therewith and extending outwardly for being slidably engaged with select ones of the plurality of slots, said plurality of side members having substantially triangular shapes with said plurality of flange portions being spaced along one edge portion thereof, and a beverage supporting section removably attachable to said rear member and comprising a bottom surface for maintaining beverage vessels thereon during operating conditions, and a plurality of mobile members for being repeatedly tossed between said plurality of targets and into the respective apertures thereof, wherein said plurality of targets can be disassembled and stored during non-operating conditions.

15. The assembly of claim 14, wherein the angle measures approximately 45 degrees.

16. The assembly of claim 14, wherein the plurality of apertures are centered along the axis.

17. The assembly of claim 14, wherein said beverage supporting section further comprises: a plurality of oppositely spaced support members having a plurality of flange portions slidably engageable with associated ones of the plurality of slots, said plurality of support members each having a groove formed therein and facing inwardly toward the axis for removably receiving and maintaining said bottom surface at a substantially horizontal position.

18. The assembly of claim 14, wherein said plurality of mobile members comprise: a plurality of bean bags respectively.

* * * * *